US009759431B2

(12) United States Patent
Gopalakrishnan

(10) Patent No.: US 9,759,431 B2
(45) Date of Patent: Sep. 12, 2017

(54) Y-SHAPED OVEN FLUE

(71) Applicant: Electrolux Home Products, Inc., Charlotte, NC (US)

(72) Inventor: Sabarinath Mathumala Gopalakrishnan, Hendersonville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 488 days.

(21) Appl. No.: 14/160,593

(22) Filed: Jan. 22, 2014

(65) Prior Publication Data

US 2015/0204545 A1 Jul. 23, 2015

(51) Int. Cl.
*F24C 15/20* (2006.01)

(52) U.S. Cl.
CPC ..... *F24C 15/2007* (2013.01)

(58) Field of Classification Search
CPC ..... F24C 15/20; F24C 15/2007
USPC ..... 126/21 R, 300
See application file for complete search history.

(56) References Cited

U.S. PATENT DOCUMENTS 1,716,534 A * 6/1929 Scott ..... F24C 3/027 126/39 C
2,886,124 A 5/1959 Scharner
3,310,046 A * 3/1967 Scott ..... F24C 14/02 126/21 A
3,328,560 A * 6/1967 Dills ..... F24C 15/2007 126/21 A
3,358,669 A * 12/1967 Schibley ..... F24C 15/30 126/37 R
3,530,784 A 9/1970 Courchesne
3,952,640 A 4/1976 Kuechler
4,067,681 A 1/1978 Reid, Jr. et al.
4,616,562 A 10/1986 Kuechler
4,865,010 A * 9/1989 Kett ..... F24C 15/2007 126/21 R
5,387,258 A 2/1995 Puricelli
5,693,242 A * 12/1997 Sanchez ..... F24C 15/322 126/21 A
5,738,081 A 4/1998 Puricelli
6,588,350 B1 7/2003 Somers
6,647,978 B1 11/2003 Khosropour et al.
6,761,159 B1 7/2004 Barnes et al.
7,699,051 B2 4/2010 Gagas et al.
7,762,250 B2 7/2010 Elkasevic et al.
2012/0255539 A1 10/2012 Kolecki

* cited by examiner

*Primary Examiner* — Avinash Savani
(74) *Attorney, Agent, or Firm* — Pearne & Gordon, LLP

(57) ABSTRACT

A gas oven includes an oven cavity, an oven door and a channel. The oven door is configured to provide access to the oven cavity. The channel is located above the oven cavity and includes an inlet in fluid communication with the oven cavity. The channel further includes a first outlet and a second outlet which are in fluid communication with an exterior of the gas oven. The channel is configured to allow gases in the oven cavity to enter the channel through the inlet and exit the channel through any of the first outlet and the second outlet. The first outlet and the second outlet are located higher than the inlet.

19 Claims, 4 Drawing Sheets

Y-SHAPED OVEN FLUE

TECHNICAL FIELD

The present disclosure relates to gas ovens, more specifically, apparatuses and methods of venting flue gases from gas ovens.

BACKGROUND

Combustion inside an oven can create flue gases that can be detrimental in a number of ways. For example, the flue gases that are not exhausted from the oven cavity can raise the level of carbon monoxide during bake and broil operations of the oven and can raise the overall temperature of the upper area of the appliance in which the oven is located. Moreover, certain configurations for channeling the flue gases out of the range may create warm or hot areas around the oven that is unpleasant or harmful to a user accessing these areas.

Thus, there is a need for apparatuses or methods that can channel flue gases out of the oven cavity while addressing some or all of these issues.

SUMMARY

In a first example, a gas oven includes an oven cavity, an oven door and a channel. The oven door is configured to provide access to the oven cavity. The channel is located above the oven cavity and includes an inlet in fluid communication with the oven cavity. The channel further includes a first outlet and a second outlet which are in fluid communication with an exterior of the gas oven. The channel is configured to allow gases in the oven cavity to enter the channel through the inlet and exit the channel through any of the first outlet and the second outlet. The first outlet and the second outlet are located higher than the inlet.

In one aspect of the first example, the gas oven includes a trim that is located above the oven door and spans a width of the oven door. The trim includes a component located at an intermediate portion of the trim. The first outlet and the second outlet is disposed along the width of the trim and is located on laterally opposite sides with respect to the component.

In another aspect of the first example, the component is a control panel.

In yet another aspect of the first example, the first outlet and the second outlet are located above the component.

In yet another aspect of the first example, the trim further includes a top edge, the first outlet and the second outlet located along the top edge.

In yet another aspect of the first example, the channel is defined by a pipe.

In yet another aspect of the first example, the pipe is substantially Y-shaped.

In yet another aspect of the first example, the pipe includes a first leg that is substantially straight between the inlet and the first outlet and a second leg that is substantially straight between the inlet and the second outlet.

In yet another aspect of the first example, the pipe contacts neighboring components only at the inlet, the first outlet and the second outlet.

In yet another aspect of the first example, the inlet is curved toward the oven cavity.

In a second example, a gas oven includes an oven cavity, an oven door, a channel and a trim. The oven door is configured to provide access to the oven cavity. The channel is located above the oven cavity and includes an inlet in fluid communication with the oven cavity. The channel further includes a first outlet and a second outlet which are in fluid communication with an exterior of the gas oven. The channel is configured to allow gases in the oven cavity to enter the channel through the inlet and exit the channel through any of the first outlet and the second outlet. The trim is located above the oven door and spans a width of the oven door. The trim includes a component located at an intermediate portion of the trim. The first outlet and the second outlet are disposed along the width of the trim and located on laterally opposite sides with respect to the component.

In one aspect of the second example, the component is a control panel.

In another aspect of the second example, the first outlet and the second outlet are located above the component.

In yet another aspect of the second example, the trim further includes a top edge, and the first outlet and the second outlet are located along the top edge.

In yet another aspect of the second example, the channel is defined by a pipe.

In yet another aspect of the second example, the pipe is substantially Y-shaped.

In a third example, a method of venting flue gases from a gas oven is provided. The gas oven includes an oven cavity. An oven door is configured to provide access to the oven cavity. The gas oven further includes a trim and a control panel located at an intermediate portion of the trim. The method comprises a step of channeling flue gases to a cavity exit located upwardly of the oven cavity. The method further comprises a step of channeling flue gases toward a first region. The method further comprises a step of channeling flue gases toward a second region. The first region and the second region are located on laterally opposite sides of the control panel. Flue gases at the first region and the second region are located higher than the cavity exit.

In one aspect of the third example, the first region and the second region are located above the control panel.

In another aspect of the third example, the trim includes a top edge, and the first outlet and the second outlet are located along the top edge.

In yet another aspect of the third example, the method further includes the steps of channeling flue gases toward the first region and channeling flue gases toward the second region involve moving flue gases along a substantially straight and sloped path.

BRIEF DESCRIPTION OF THE DRAWINGS

These and other aspects are better understood when the following detailed description is read with reference to the accompanying drawings, in which.

DETAILED DESCRIPTION

Figure 1:
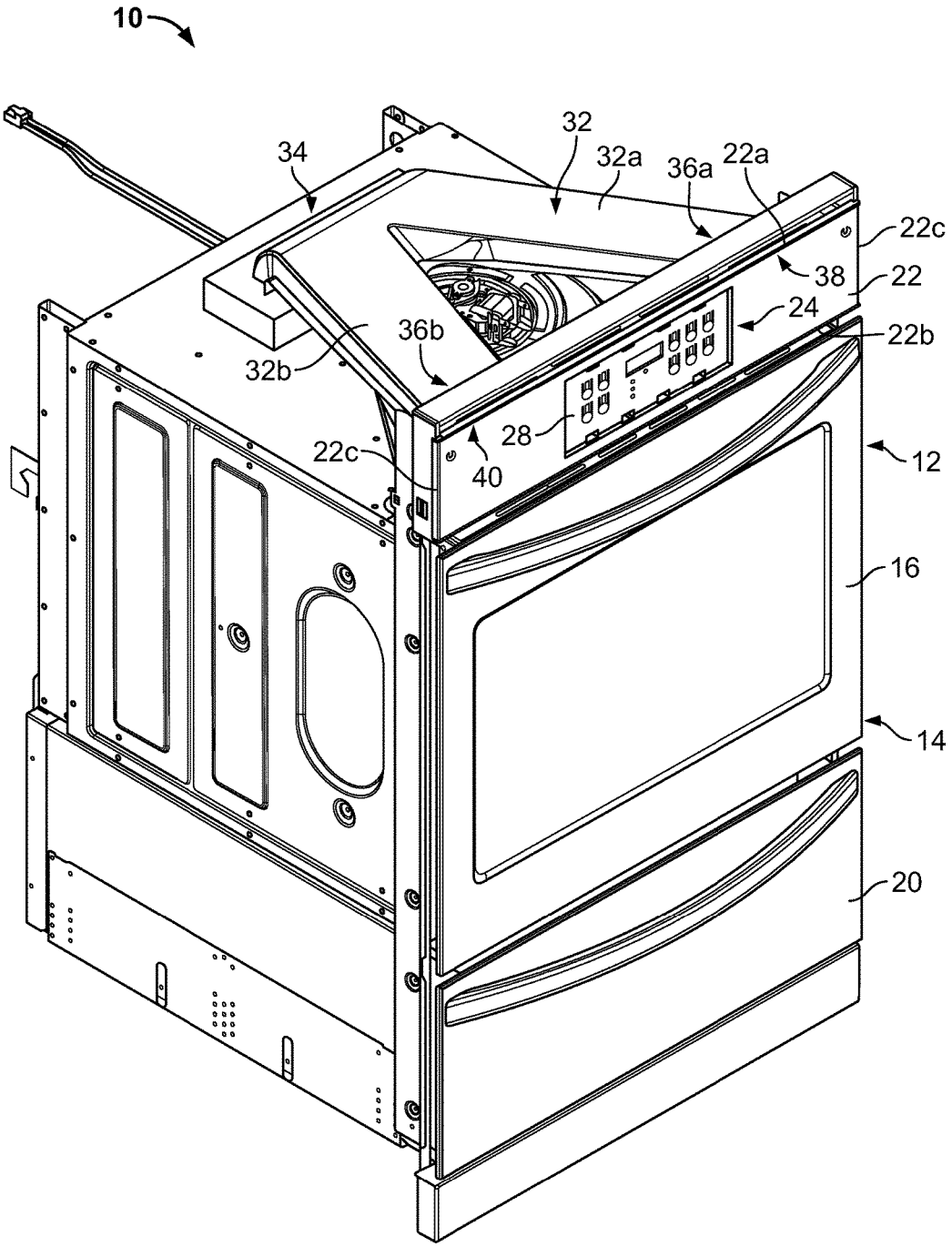
FIG. 1 is a front perspective view of an example embodiment of a range that includes an oven and is implemented with an example embodiment of a pipe discussed herein.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Figure 2:
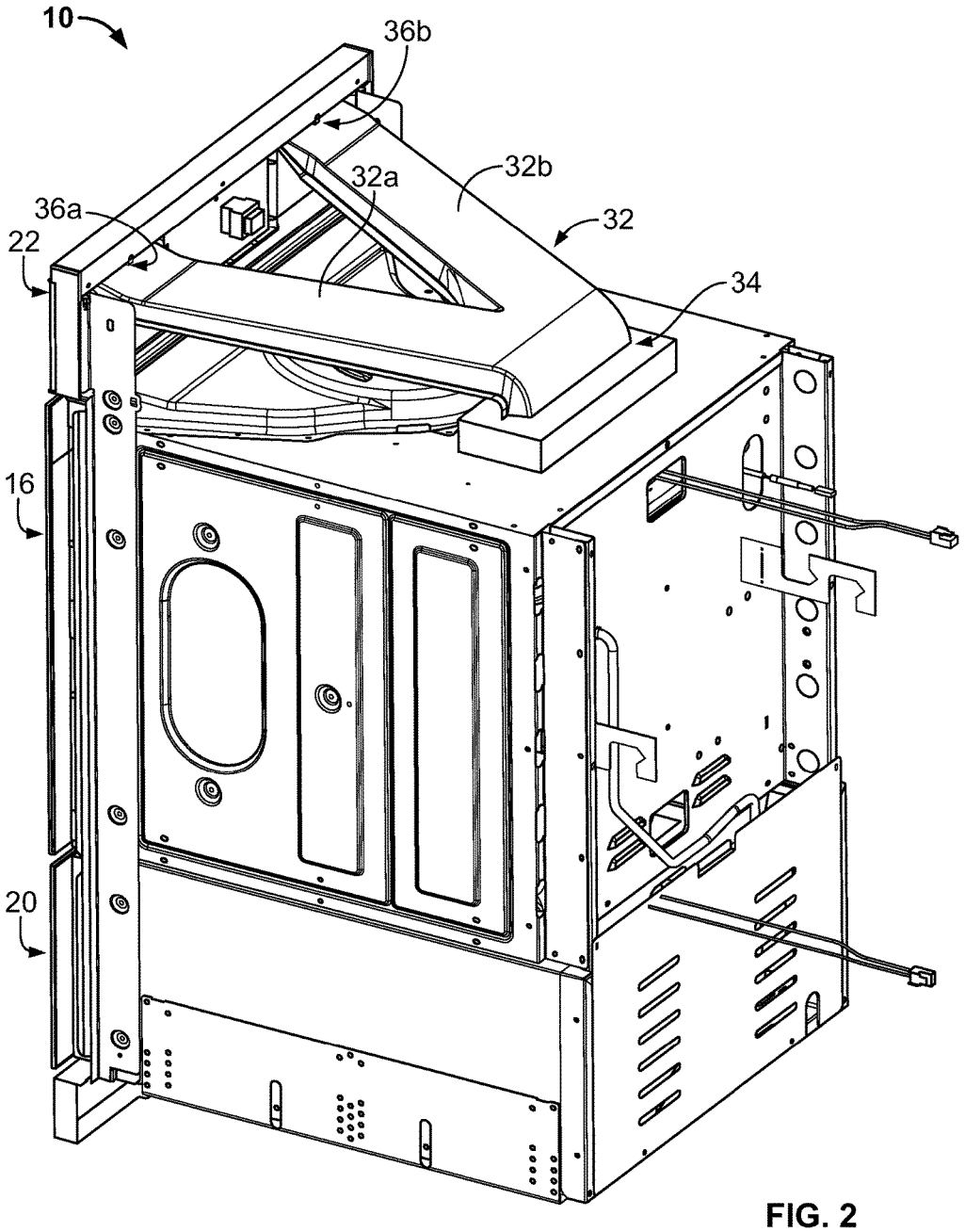
FIG. 2 is a rear perspective view of the range in FIG. 1 in which the pipe is shown with a first leg and a second leg.

Referring now to FIG. 1-2, an example embodiment of a device implemented with the apparatus or method discussed herein is illustrated. The example device is a home cooking appliance and, more specifically, a range 10 that includes an oven 12 and provides heating by burning gas. However, there may be other example devices (e.g., a range with multiple oven cavities or a gas furnace) which can be implemented with the apparatus or method discussed herein. The oven 12 may be of a self-clean type.

Figure 3:
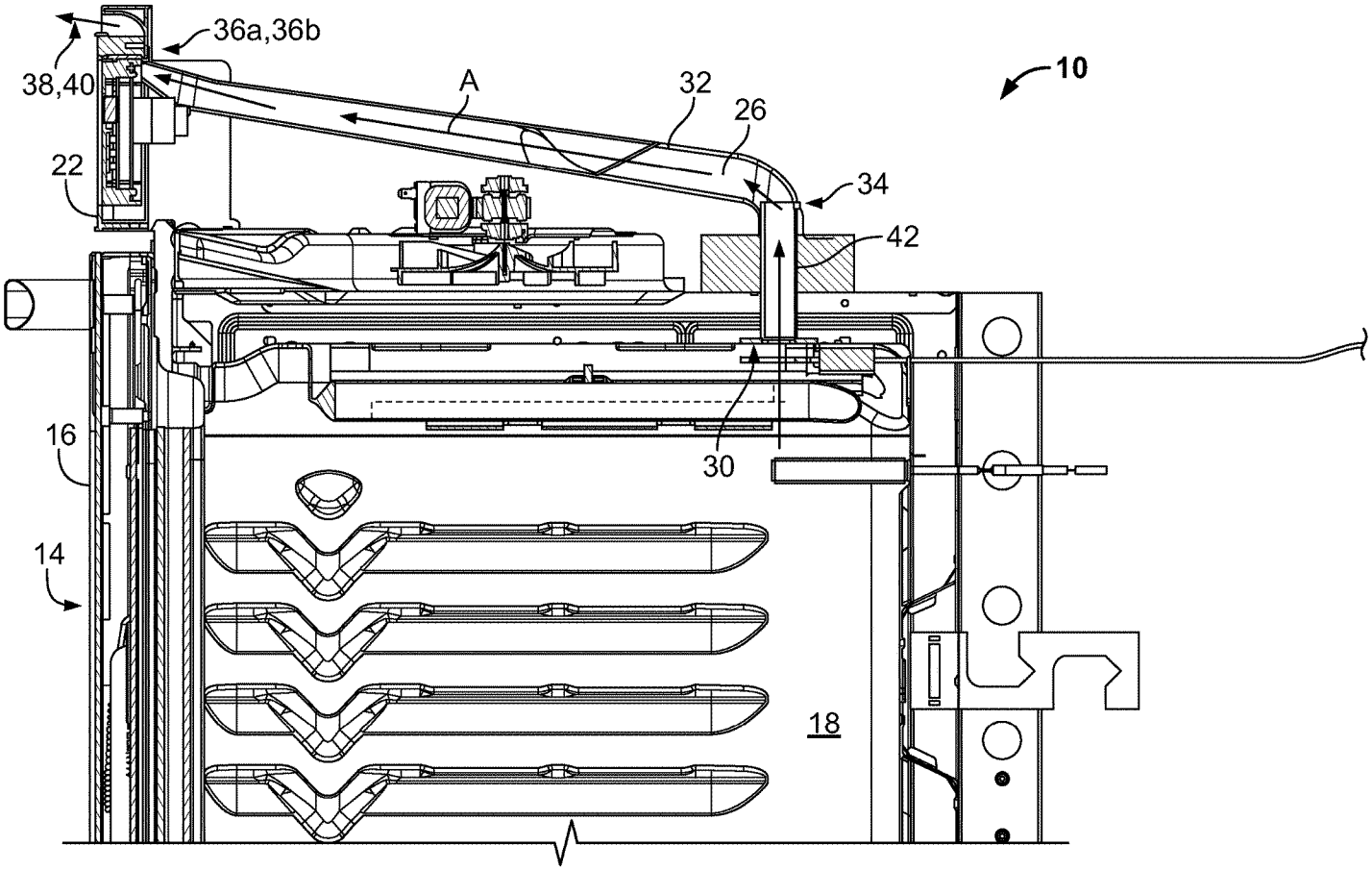
FIG. 3 is a cross-sectional view of the range in FIGS. 1-2 in which the pipe is shown in fluid communication with an oven cavity and an exterior of the range.
Figure 4:
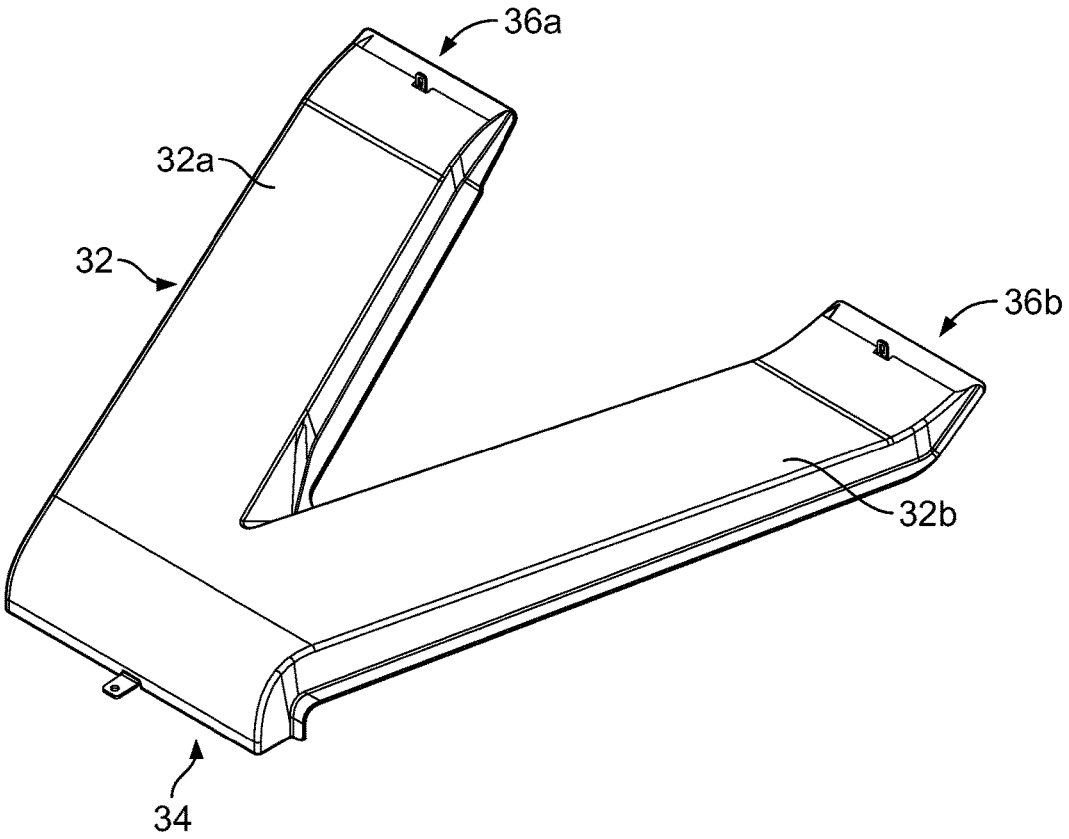
FIG. 4 is an isolated view of the pipe including an inlet, a first outlet and a second outlet.

The example range 10 is shown in FIG. 1-2 without some of the panels that define the exterior surfaces of the range 10. Thus, the range 10 is shown in FIG. 1 only with a front surface 14 that is partly defined by an oven door 16 which allows access to an oven cavity 18 (FIG. 3). The range 10 may further include a top panel, side panels and a rear panel which are omitted from FIGS. 1-2 for purposes of illustrating the interior components of the range 10. The front surface 14 of the range 10 may be further defined by a drawer 20 that is located below the oven door 16 allowing access to interior components for maintenance or repairs to the oven 12 or other features of the range 10. The front surface 14 may be further defined by a top panel that serves as a trim 22 and is located above the oven door 16. The trim 22 may be rectangular with a top edge 22*a*, a bottom edge 22*b* and side edges 22*c* and may extend laterally on the front surface 14 so as to span a width of the oven door 16. The trim 22 may provide an opening 24 at an intermediate portion thereof and a component may be mounted thereon. The component may be a control panel 28 with a user interface that includes a set of controls (e.g., switches, knobs, etc.) and displays used to operate the range 10. The opening 24 may be formed at a vertical and horizontal center of the trim 22 so that the control panel 28 is centrally positioned with respect to the trim 22.

Heating of food items inside the oven cavity 18 occurs by way of combustion. As a result, flue gases are created within the oven cavity 18 and may need to be exhausted therefrom. Thus, the range of FIG. 1 may provide a channel 26 which is located above the oven cavity 18 and through which flue gases can exit and be vented out of the oven cavity as indicated by the arrows A in FIG. 3. In the present embodiment, a cavity exit 30 is provided upwardly of the oven cavity 18 such that hot flue gases can rise and exit the oven cavity 18 through the cavity exit 30. A flue 32 which may be embodied as a pipe or a manifold that has a hollow interior and channels the flue gases from the oven cavity 18 to the exterior of the range 10. The flue 32 may be mounted above the oven cavity 18 and may define the channel 26 that is in fluid communication with the oven cavity 18. The flue 32 may be substantially V-shaped or Y-shaped and may include a first leg 32*a* and a second leg 32*b* each of which provides a passage out of the range 10. The first leg 32*a* may extend from an inlet 34 to a first outlet 36*a* while the second leg 32*b* may extend from the inlet 34 to the second outlet 36*b*. The inlet 34 is in communication with the oven cavity 18 while the first outlet 36*a* and the second outlet 36*b* are in communication with the exterior of the range 10. Thus, the flue gases from the oven cavity 18 may enter the channel 26 through the inlet 34 and exit the channel 26 through either the first outlet 36*a* or the second outlet 36*b*.

The flue 32 is disposed inside the range 10 and above the oven cavity 18 so that flue gases are directed toward the top of the front surface 14. Thus, the first outlet 36*a* and the second outlet 36*b* are located higher than the cavity exit 30 or the inlet 34. Moreover, the first leg 32*a* and the second leg 32*b* may provide sloped passages for the flue gases from the top of the oven cavity 18 to the front surface 14. The first leg 32*a* and second leg 32*b* may be substantially straight between the inlet 34 and the first outlet 36*a* and the second outlet 36*b* respectively as shown in FIGS. 1-3 or may be curved, have bends or be a combination of these configurations. In the present embodiment, the first outlet 36*a* and the second outlet 36*b* are located along the top edge 22*a* of the trim 22 as shown in FIG. 1. Consequently, the first outlet 36*a* and the second outlets 36*b* are also located above the control panel 28. Furthermore, the first outlet 36*a* and the second outlet 36*b* are located on laterally opposite sides with respect to the control panel 28. Specifically, the first outlet 36*a* is located near one end of the top edge 22*a* (i.e., a first region 38) while the second outlet 36*b* is located near the other end of the top edge 22*a* (i.e., a second region 40).

Figure 5:
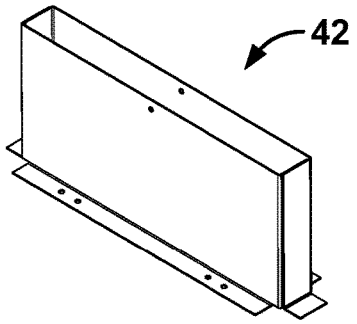
FIG. 5 is an example embodiment of an adapter located between the pipe and an oven cavity.

As shown in FIG. 3, the flue 32 may be curved downward at the inlet 34 thereby making it easier to connect the flue to the oven cavity 18. A box-like adapter 42 (FIG. 5) may connect to the inlet 34 and guide the flue gases out of the oven cavity 18 toward the flue 32. Moreover, the flue 32 may be sloped further upward at the first outlet 36*a* and the second outlet 36*b* as shown in FIG. 3. Furthermore, the flue 32 is disposed within the range 10 such that contact with other components inside the range 10 is reduced and heat conduction from the flue 32 to the components is less likely. For example, the flue 32 may only contact neighboring components inside the range 10 at the inlet 34, the first outlet 36*a* and the second outlet 36*b* as shown in FIG. 2. Moreover, the flue 32 may include insulation on the exterior to restrict heat conduction to components in contact with the flue 32.

Based on the configurations described above, the example range 10 can operate in the following manner. A food item is placed inside the oven cavity 18 and creates flue gases therein. The flue gases can exit the oven cavity 18 through the cavity exit 30 and are channeled through the adapter 42 and toward the inlet 34 of the flue 32. The flue gases can thereafter be channeled to any of the first leg 32*a* and the second leg 32*b* toward the first outlet 36*a* and the second outlet 36*b* respectively. The flue gases may be channeled to both legs 32*a* and 32*b* in a substantially equal manner. Because of their elevated temperatures, the flue gases naturally rise as they move through the sloped channel 26 and do not require a separate mechanism (e.g., a fan) to drive the gases through the channel 26 of the flue 32. Moreover, the locations of the first outlet 36*a* and the second outlet 36*b* channel the flue gases away from areas on the range 10 that a user may access with their hands (e.g., the control panel 28 located at an intermediate portion of the trim 22) or may stand in proximity to. Furthermore, the angled configuration of the flue 32 also keeps the hot surfaces of the flue 32 away from the exterior surfaces of the oven 12 that a user get close to during use of the range 10. Also, because the outlets 36*a*, 36*b* are shaped to be elongate extending along the top edge 22*a*, the outlets 36*a*, 36*b* for flue gases can be formed without increasing the size of the range 10 or the front surface 14. Furthermore, the carbon monoxide values can be reduced for bake and broil operations of the oven 12.

It will be apparent to those skilled in the art that various modifications and variations can be made without departing from the spirit and scope of the claimed apparatus or method.

What is claimed is:

1. A gas oven including:

an oven cavity;

an oven door configured to provide access to the oven cavity;

a channel located above the oven cavity, said channel comprising:

an inlet in fluid communication with the oven cavity, a first outlet and a second outlet which are in fluid communication with an exterior of the gas oven, the channel configured to allow gases in the oven cavity to enter the channel through the inlet and exit the channel through any of the first outlet and the second outlet, a first leg providing fluid communication between the inlet and the first outlet, and a second leg providing fluid communication between the inlet and the second outlet, wherein:

the first leg and the second leg each comprise a first end adjacent the inlet and a second end defining the respective outlet, each of the second ends being located higher than the inlet, and the inlet being curved toward the oven cavity.

2. The gas oven of claim 1, further including a trim located above the oven door and spanning a width of the oven door, the trim including a component located at an intermediate portion of the trim, the first outlet and the second outlet disposed along the width of the oven door and located on laterally opposite sides with respect to the component.

3. The gas oven of claim 2, wherein the component is a control panel.

4. The gas oven of claim 2, the first outlet and the second outlet located above the component.

5. The gas oven of claim 4, the trim further including a top edge, the first outlet and the second outlet located along the top edge.

6. The gas oven of claim 1, wherein the channel is defined by a pipe.

7. The gas oven of claim 6, wherein the pipe is substantially Y-shaped.

8. The gas oven of claim 6, wherein the first leg is substantially straight between the inlet and the first outlet and the second leg is substantially straight between the inlet and the second outlet.

9. The gas oven of claim 6, wherein the pipe contacts neighboring components only at the inlet, the first outlet and the second outlet.

10. A gas oven including:

an oven cavity;

an oven door configured to provide access to the oven cavity;

a channel located above the oven cavity, said channel comprising:

an inlet in fluid communication with the oven cavity, a first outlet and a second outlet which are in fluid communication with an exterior of the gas oven, the channel configured to allow gases in the oven cavity to enter the channel through the inlet and exit the channel through any of the first outlet and the second outlet;

a first leg providing fluid communication between the inlet and the first outlet, a second leg providing fluid communication between the inlet and the second outlet; and a trim located above the oven door and spanning a width of the oven door, the trim including a component located at an intermediate portion of the trim, the first outlet and the second outlet disposed along the width of the oven door and located on laterally opposite sides with respect to the component, wherein:

the first leg and the second leg each comprise a first end adjacent the inlet and a second end defining the respective outlet, each of the second ends being located higher than the inlet.

11. The gas oven of claim 10, wherein the component is a control panel.

12. The gas oven of claim 10, the first outlet and the second outlet located above the component.

13. The gas oven of claim 12, the trim further including a top edge, the first outlet and the second outlet located along the top edge.

14. The gas oven of claim 10, wherein the channel is defined by a pipe.

15. The gas oven of claim 14, wherein the pipe is substantially Y-shaped.

16. A method of venting flue gases from a gas oven, the gas oven including an oven cavity, an oven door configured to provide access to the oven cavity, the gas oven further including a trim and a control panel located at an intermediate portion of the trim, the method comprising steps of:

channeling flue gases to a cavity exit located upwardly of the oven cavity;

channeling flue gases toward a first region; and channeling flue gases toward a second region, wherein the first region and the second region are located on laterally opposite sides of the control panel along a width of the oven door, and flue gases at the first region and the second region are located higher than both the cavity exit and the inlet, and wherein the first region and the second region are located above the control panel.

17. The method of claim 16, wherein the trim includes a top edge, and the first outlet and the second outlet are located along the top edge.

18. The method of claim 16, wherein the steps of channeling flue gases toward the first region and channeling flue gases toward the second region involve moving flue gases along a substantially straight and sloped path.

19. The gas oven of claim 1, wherein the first leg and the second leg are both sloped upward and away from both the oven cavity and the inlet.

* * * * *